US005954209A

United States Patent [19]

Wurm et al.

[11] Patent Number: 5,954,209

[45] Date of Patent: Sep. 21, 1999

[54] BORING ROD MAGAZINE

[75] Inventors: Dieter Wurm, Kirchhundem; Gerhard Völkel, Erndtebrück, both of Germany

[73] Assignee: Tracto-technik Paul Schmidt Spezialmaschinen, Lennestadt, Germany

[21] Appl. No.: 08/815,829

[22] Filed: Mar. 12, 1997

[30] Foreign Application Priority Data

Mar. 20, 1996 [DE] Germany ..... 196 10 883

[51] Int. Cl.[6] ..... A47F 7/00

[52] U.S. Cl. ..... 211/70.4; 175/52; 175/85; 211/164

[58] Field of Search ..... 175/52, 85; 211/70.4, 211/70, 1.53, 1.52, 1.55, 164

[56] References Cited

U.S. PATENT DOCUMENTS

| | | | |
|---|---|---|---|
| 1,684,008 | 9/1928 | Bouslog | 211/70.4 |
| 3,157,286 | 11/1964 | Gyongyosi | 211/1.53 |
| 3,840,079 | 10/1974 | Williamson . | |
| 3,870,165 | 3/1975 | Besijn | 211/70.4 X |
| 4,445,579 | 5/1984 | Bello | 211/1.53 X |
| 4,547,110 | 10/1985 | Davidson . | |
| 4,834,195 | 5/1989 | Robinson . | |
| 5,263,545 | 11/1993 | Tudora et al. | 211/70.4 X |

FOREIGN PATENT DOCUMENTS

| | | |
|---|---|---|
| 2 544 789 | 10/1984 | France . |
| 1 483 865 | 1/1970 | Germany . |
| 24 35 535 | 2/1978 | Germany . |
| 27 21 342 | 11/1978 | Germany . |
| 38 19 537 | 12/1989 | Germany . |
| 40 30 525 | 4/1992 | Germany . |
| WO 91/19880 | 12/1991 | WIPO . |

*Primary Examiner*—Robert W. Gibson, Jr.

[57] ABSTRACT

A boring-rod magazine which can be moved into the drilling axis of a boring machine. The boring-rod magazine may contain a plurality of boring rods, and holds a boring rod to position it in the drilling axis, and then releases the boring rod when boring-rod magazine is removed. The boring-rod magazine may include a carousel closed by a cover with a transfer opening for the boring rods. The magazine may include compartments for the boring rods, and spring mechanisms for holding and releasing the rods. The magazine may be rotated by a drive and kept in position by a rotary stop.

10 Claims, 2 Drawing Sheets

BORING ROD MAGAZINE

FIELD OF THE INVENTION

The invention relates to a magazine for boring rod elements, which makes it possible to add a boring rod element to a boring rod in a technically simple manner in that a movable rod magazine is moved into the area of the drilling axis in order to position a rod element located at a transfer location in the drilling axis or to receive a rod element located in the drilling axis in the magazine.

The invention relates to a boring rod magazine by means of which rod elements can be brought into an assembly or disassembly position.

BACKGROUND OF THE INVENTION

During subterranean drilling operations involving the digging of a ditch, the boring rods disappear progressively in the earth as the drilling continues. For this reason, as the drilling progresses it is necessary to combine rod elements with the rods entering the drilling location and, in this way, to constantly lengthen the boring rods. As a rule, a multitude of rod elements is stored in the area of the drilling device.

During driving, the rod anchored in the drilling axis is introduced into the ground, for example, by means of the rotary drive of a mount. For the purpose of extending the rods in stages, one rod element, respectively, is mounted between the rear end of the rods located in the ground and the rotary drive. Subsequently, the rods are introduced into the ground by an additional section before the next rod element is connected with the rear end of the rod protruding out of the ground. The mounting takes place, for example, on the rod shaft of a drilling mount. For this purpose, the rod element must be positioned on the rod shaft.

A similar process takes place—in reverse order—while the boring rods are being pulled out of the ground. In this way, for example, during the widening of a pilot hole, an expander head is moved through the pilot hole by pulling back the boring rods. For this purpose, the rod element of the boring rod, which is protruding more and more from the ground, must be released, removed from the bore axis and, for example, must be deposited in a magazine. In this case, known arrangements make use of the mechanics used for the placement of the rod elements.

In order to facilitate the positioning of the boring rods, various arrangements are known, wherein, as a rule, several rod elements are located in one magazine. In the area of the magazine, a gripper is located with the aid of which a rod element can be removed from the magazine and can be placed at the rear end of the boring rods located in the ground.

The German Auslegeschrift 2,721,342 describes a magazine device and a device for operating boring rod elements, wherein a gripper, grips boring rod elements located in a magazine by means of an arm, lifts them out and places them in the predetermined position.

The known devices have a more or less costly supply and removal mechanism, which moves the rod elements either mechanically or manually by means of the operating personnel into and out of the drilling axis; they are expensive and require much space. This has a negative effect particularly in the case of mobile drilling devices. The latter must be easy to transport, must be maneuverable and as nonbulky as possible.

SUMMARY OF THE INVENTION

It is the task of the invention to create a magazine for supplying boring rod elements that makes it possible to add a boring rod element to boring rods located in the ground by means of a simplified technology.

The solution of the problems is based on the idea that the rod elements are kept in readiness in a magazine in the area of the rod assembly or disassembly site such that a special positioning of the individual rod element becomes unnecessary and its operation is possible in a few steps without costly control.

In detail, the problem is solved by means of a boring rod magazine with a movable rod compartment and a rod transfer location. The rod compartment may be movable on rails and can be moved as a whole into its operating position in the area of the drilling axis in order to bring a rod that is in the transfer location into the drilling axis or in order to receive a rod element, located in the drilling axis, in the magazine.

The rod magazine may consist of a shaft accommodating the rods and preferably extends parallel to the drilling axis. The rod element that is in the transfer location is held in its position by means of movable rod holders, preferably by means of spring elements. During the mounting of the rod element, the rod magazine is moved until the rod element in the transfer location is located in the predetermined mounting position and hence in the drilling axis. Then, the rod element is fixed between the boring rods located in the ground and the drive shaft of a bore mount, and the rod magazine is again moved back, at which time the rod element connected with the boring rods is automatically released by the spring elements and remains in the drilling axis.

When a rod element is taken from the drilling axis, for example, during widening of a pilot hole, the magazine is moved to the area of the drilling axis as during the rod transfer, so that the outermost rod element, located in the drilling axis, is pressed against the spring elements and moves these apart until it comes to rest at the transfer location.

Preferably, the rod magazine consists of a rotary platen, in which the boring rod elements are located in radially extending compartments. The compartments may be open when the rotary platen is surrounded by a cover with a transfer opening in front of which movable rod holders are located. When a compartment has been turned into its transfer position, the transfer opening in the cover for the rod elements in the compartment is located directly in front of the opening of the compartment. The rotary platen may be located next to the bore mount and can be moved by means of a simple drive arrangement on rails extending diagonally with respect to the drilling axis, between the transfer position and a resting position.

Another arrangement in accordance with the invention consists of a shaft-like, equally movable rod compartment, having an opening of the length of a rod element, from which the rod elements must be removed in the already described manner from the rod itself. The narrow opening, which is not much broader than the pipe diameter, forces the rod elements to arrange themselves in a single row, so that the rod elements lie individually, one behind the other. The rod elements are secured and released again via spring elements which are overcome by the force exerted by the rod on the rod element to be handled, or by means of axially displaceable safety pegs which grip into the rod elements and which are moved mechanically.

BRIEF DESCRIPTION OF THE DRAWINGS

In the following text, the invention is explained in greater detail by means of an example shown in the drawing. In the drawing.

DETAILED DESCRIPTION OF PREFERRED EMBODIMENTS

Figure 1:
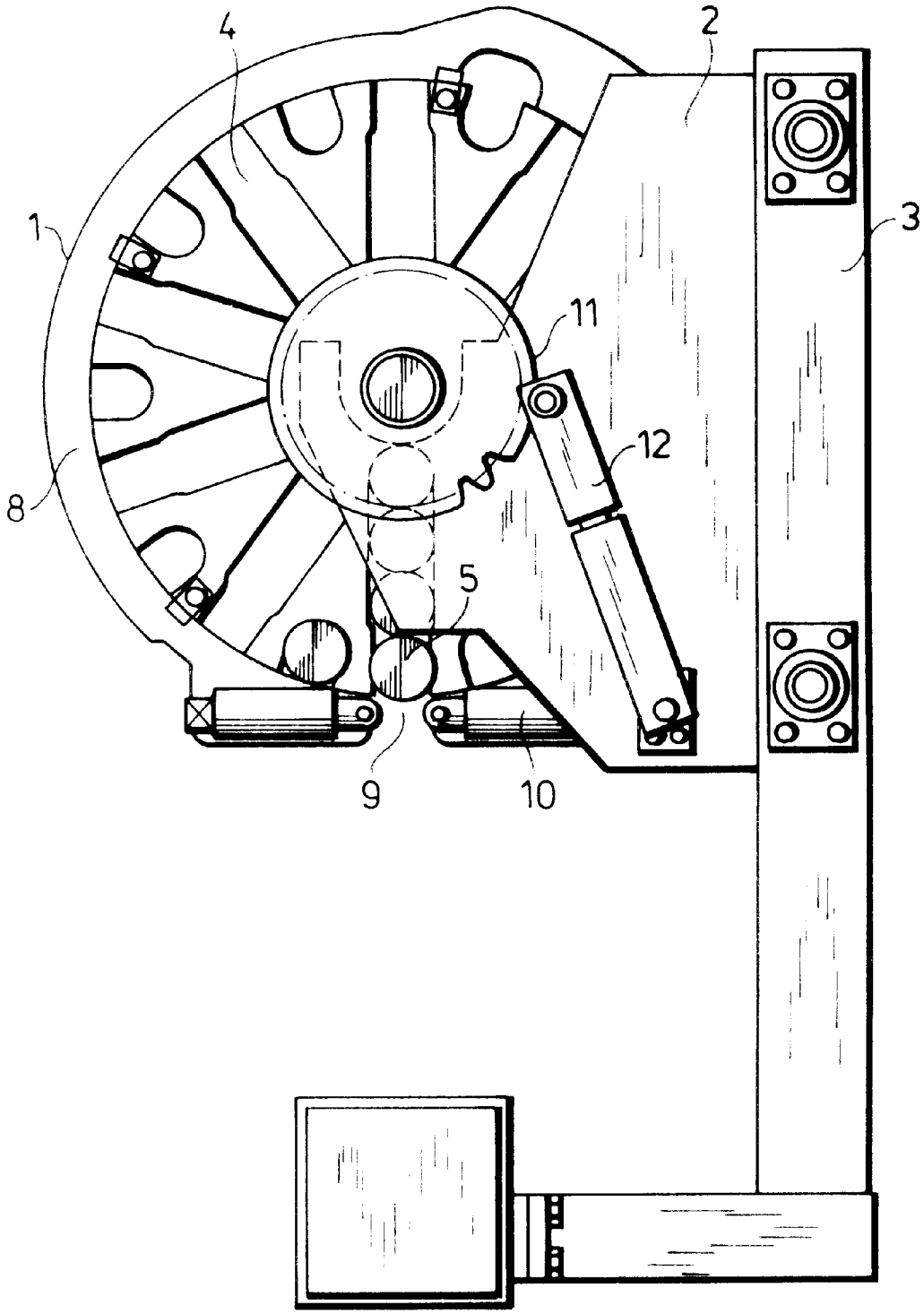
FIG. 1 shows the front view of a rod magazine in accordance with the invention.
Figure 3:
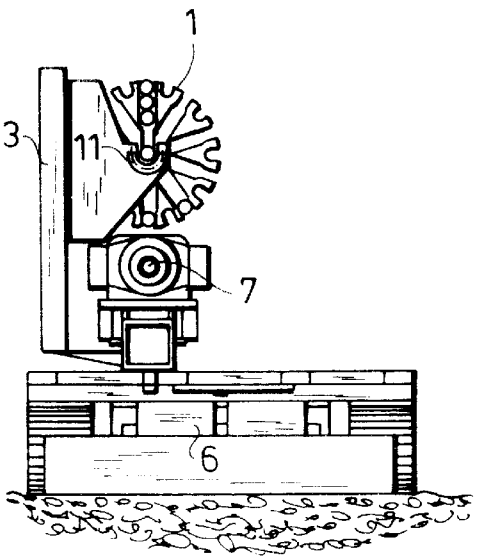
FIG. 3 shows a front view of FIG. 2.
Figure 2:
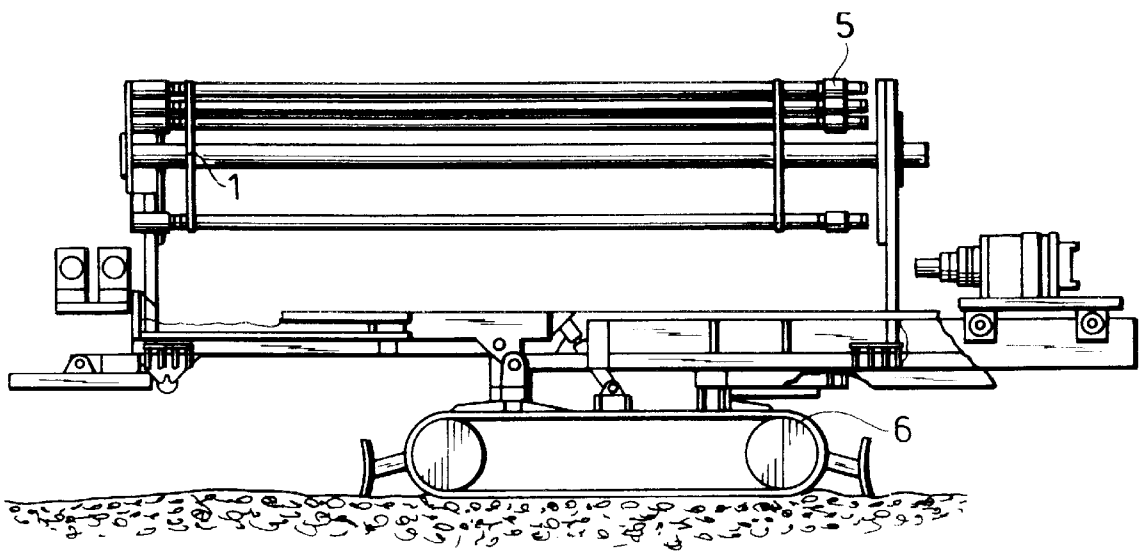
FIG. 2 shows a side view of the rod magazine of FIG. 1 with a mount.

The magazine consists of a rotary platen (1), which is movably arranged in two rails (3) via a bracket (2) and is provided with concentrically arranged radial rod compartments (4). In the rod compartments (4), rod elements (5) are located. Depending on the circumference of the rotary platen, it is possible to arrange several rod elements (5) behind each other in the rod compartment (4). Rod compartment (4) is provided on a mount (6) and extends diagonally with respect to the drilling axis, so that by a diagonal movement of the rotary platen (1), an external rod element (5) located in a rod compartment (4) can be moved into the drilling axis (7).

The rotary platen (1) is surrounded by a cover (8) with a transfer slot (9) corresponding to the length of the rod element (5). Parallel to the drilling axis, rod holders are located in front of the transfer slot which are in the form of spring elements (10) facing each other for the purpose of securing arid releasing the rod elements (5). The rod elements may also be held in their compartments (4) in a form-fitting manner by means of opposing slide elements or fingers or by means of a retaining ring (not shown), which is arranged along the periphery of the rotary platen (1) and mechanically releases the rod elements (5), for example, by exposing a slot opening.

On the axis of the rotary platen (1), a driving pinion (11) is arranged which secures the rotary platen (1) against autorotation caused by a shift in weight and simultaneously serves as a stepping mechanism for the gradual continued turning of the rotary platen by one compartment distance, respectively. This takes place with the aid of a driving rod (12).

The rotary platen (1), with the aid of a simple drive unit along the rails (3), can be moved perpendicularly with respect to the drilling axis in order to thus shift the rod transfer (9) into the drilling axis (7).

The transfer of a rod element (5) and its mounting at the free or rearward end of the boring rod located in the ground takes place in the following steps.

At first, the rotary platen (1) is lowered so that the rod element (5) located at the transfer slot (9) of the rotary platen, is located within the drilling axis. In this position, the rod element (5), with the aid of a rotary drive, is screwed together to the rearward end of the rod located in the ground via a screw thread. The rod element (5) is then tightly connected with the boring rods.

Subsequently, the rotary platen (1) is moved back into its initial position. The spring elements (10) open in the manner of a mouth and automatically release the rod element (5), which is screwed together with the boring rod, during the return movement of the rotary platen (1), since it is fixed in the drilling axis and the spring elements are pressed apart by the rod element. Subsequently, the transfer point (9,10) is freed up and the subsequent rod element (5) inside the rod compartment (4) can slide away up to the spring elements (10). During each rod removal, the rotary platen (1) is turned with the aid of the driving rod (12) and the pinion (11) is turned by the distance of one compartment, in order to achieve a uniform rod removal along the periphery of the rotary platen.

When a rod is picked up, as is necessary, for example, during expansion drilling, wherein a boring rod located in the ground is shortened piece by piece, the rotary platen (1)—with its rod transfer arrangement (9,10)—moves into the drilling axis (7), where a rod element (5), which is still connected with the boring rod, is located. At that point, this rod element is overrun by the spring elements (10) which move apart automatically. At that time, the rod element to be picked up presses the rod element located at the rod transfer (9,10), back into the rod compartment (4)—located behind it—of the rotary platen (1) and itself assumes its position. The rod element introduced into the rod compartment (4), is then released by the boring rod located in the ground, and the rotary platen (1) is moved back into its initial position. At that point, the rotary platen is turned by the distance of one compartment, whereby a uniform filling of the rod compartments is assured.

Altogether, the delivery of the rod, as well as the receiving of the rod, can be carried out by means of a continuous sequence of steps which, in addition to the release or attachment of the rod elements with respect to the boring rod inside the ground, is exhausted in a downward and an upward movement of the rotary platen and requires an extremely small amount of control and mechanics.

The structural simplification connected with the invention is based on the principle of moving the magazine or the rod compartment to the boring rod and—after screwing together a rod element and the boring rod—to use the boring rod itself instead of, for example, a gripper for the purpose of taking the rod element out of the magazine or, conversely, to introduce the respective rod element into the magazine prior to unscrewing. This is made possible by means of the mouth-like closure of the rod compartment in the form of the spring elements.

We claim:

1. A boring rod magazine comprising:

a movable rod storage for accommodating at least one boring rod and for positioning the boring rod in a drilling axis; and means for maintaining the boring rod in the movable rod storage and for releasing the boring rod when the movable rod storage is removed from the drilling axis.

2. The boring rod magazine of claim 1, further comprising a guide rail along which the rod storage is movable.

3. The boring rod magazine of claim 1, wherein the movable rod storage comprises a carousel movable at an angle to the drilling axis, the carousel comprising a plurality of radial rod compartments, the carousel being closed by a cover having a transfer slot for the boring rod.

4. The boring rod magazine of claim 3, wherein the means for maintaining and releasing the boring rods comprises slidable rod holders adjacent the transfer slot.

5. The boring rod magazine of claim 4, wherein the slidable rod holders comprise spring elements facing each other.

6. The boring rod magazine of claim 1, further comprising a rotary drive for turning the movable rod storage.

7. The boring rod magazine of claim 1, further comprising a rotation stop for the movable rod storage.

8. A boring rod magazine comprising:

a rod storage accommodating at least one boring rod, the storage being movable between a first position away from a drilling axis and a second position in the drilling axis; and means for releasing the boring rod when the rod storage is removed from the second position.

9. The boring rod magazine of claim 8, wherein the means for releasing comprises slidable rod holders adjacent the rod storage.

10. The boring rod magazine of claim 8, wherein the means for releasing comprises spring elements facing each other, forming a transfer slot therebetween.

* * * * *